US005174863A

United States Patent [19]

Emery

[11] Patent Number: 5,174,863

[45] Date of Patent: Dec. 29, 1992

[54] MOULD TRANSFER MECHANISM

[76] Inventor: Roy W. Emery, 1 Donino Court, Toronto, Ontario, Canada, M4N 2H6

[21] Appl. No.: 727,086

[22] Filed: Jul. 9, 1991

[51] Int. Cl.[5] ..... D21J 3/00

[52] U.S. Cl. ..... 162/396; 162/390; 162/391; 162/392

[58] Field of Search ..... 162/388, 389, 390, 391-395, 162/396, 397, 407, 410; 425/326.1, 327, 85, 271

[56] References Cited

U.S. PATENT DOCUMENTS

| | | | |
|---|---|---|---|
| 1,707,429 | 4/1929 | Chaplin | 162/390 |
| 2,163,585 | 6/1939 | Chaplin | 162/392 |
| 2,760,412 | 8/1956 | Lemieux | 162/391 |
| 2,772,608 | 12/1956 | Emery | 162/392 |
| 3,190,791 | 6/1965 | Potter | 162/390 |
| 3,320,120 | 5/1967 | Randall | 162/391 |
| 3,398,049 | 8/1968 | Randall | 162/390 |
| 3,661,707 | 5/1972 | Emery et al. | 162/392 |

OTHER PUBLICATIONS

"A small Canadian consulting firm has opened the door on a new technology", Reprinted from Canadian Consulting Engineer-Jun. 1974 (By Suzanne Marr).

*Primary Examiner*—Karen M. Hastings
*Attorney, Agent, or Firm*—Fetherstonhaugh & Co.

[57] ABSTRACT

In a precision moulding or finishing machine operating in continuous motion to form fully finished products from materials such as wood pulp, an improved system for transferring a preform into a transfer mould and thence into precision mating with a finishing mould in a pressing operation suitable for manufacturing products such as bowls, cups, pots and boxes, the preform remaining in one pair of moulds throughout the pressing operation. Transfer mould assemblies are transferred sequentially from one transporting carrier to another for fully rotatable mounting on releasable mounts guided precisely through a preferred endless travel path and orientation program. The concept of a releasably mounted and freely transferable transfer mould assembly provides for the addition of such functions as printing and labelling in the same continous production line.

6 Claims, 13 Drawing Sheets

MOULD TRANSFER MECHANISM

This invention relates generally to precision moulding or finishing machines of the type having an input mould carrier and a finishing mould carrier mounted on parallel axes for synchronized continuous motion along an endless path, input moulds mounted on said input mould carrier, each input mould having an input mould face, finishing moulds mounted on a finishing mould carrier, each finishing mould having a finishing mould face. In particular, this invention relates to an improved transfer system for transferring moulding materials such as preforms from the input carrier to and around on the finishing carrier and through the point of final discharge of the finished product said transfer system comprising a multiplicity of transfer moulds, each transfer mould having a transfer mould face adapted for cooperation with the input mould face of an input mould and with the finishing mould face of a finishing mould, each transfer mould being mounted on a transfer mould assembly, transfer mould carriers located sequentially with said finishing mould carrier, and mounted on parallel axes with said finishing mould carrier and said input mould carrier for synchronized continuous travel therewith, and an improved orienting control system, said transfer mould assemblies being adapted for rotation about an orientation axis and for mounting rotatably about said axis for transfer sequentially to support on releaseable mounts moveably mounted on the transporting carriers along an endless path around an enclosure along the finishing section of said finishing carrier and back and forth between said finishing carrier and said input carrier on said transfer mould carriers.

In prior devices for producing fully finished moulded articles from fibrous pulps the moulding machines currently in operation comprise a number of different pressing stations in fixed positions spaced at circumferential intervals about the axis of rotation of a carrier, and each of the moulds mounted on the carrier is indexed and presented sequentially, together with the contained product, to a different matching mould at each of the pressing stations. A number of patents have been issued describing various moulding machines including:

U.S. Pat. No. 2,163,585 (Chaplin)
U.S. Pat. No. 2,760,412 (Lemieux)
U.S. Pat. No. 2,859,669 (Leitzel)
U.S. Pat. No. 3,190,791 (Potter)
U.S. Pat. No. 3,320,120 (Randall)
U.S. Pat. No. 3,477,908 (Danille)
U.S. Pat. No. 3,661,707 (Emery et al)

An improved combination of the travel paths of the individual moulds in a matched pair of moulds for more precise mating and separating of said moulds in continuous motion is described in U.S. Pat. No. 3,661,707 issued to Roy W. Emery and John R. Emery.

The present invention is an improvement over prior art machines.

In the moulding machine of the present invention, each transfer mould element, together with its contained product, is mated sequentially with one matching finishing mould element mounted on a continuously moving finishing mould carrier, and the moulded product remains within the same matching pair of moulds in the drying and finishing process throughout their travel around on said finishing mould carrier and until the transfer mould assembly and its contained product are transferred therefrom.

The transfer system of this invention comprises a multiplicity of transfer mould assemblies each having a series of cam followers mounted circumferentially about the supporting shaft at intervals, and a series of cam tracks by means of which the transfer mould assemblies are controlled and oriented throughout their travel path between an input carrier and a finishing carrier, the number and spacing of the cam followers being adapted to provide for complete rotation through 180 degrees in either direction in relation to the main shaft of the supporting rotary carrier, as required for the transfer of the moulded products from the input carrier to the finishing carrier and thence to the point of final discharge. According to one aspect of the present invention, there is provided a moulding machine for moulding fibrous material such as wood pulp to form moulded items comprising an input carrier and a finishing carrier each mounted for continuous synchronized rotation about parallel axes, input moulds mounted on said input carrier, each input mould having an input mould face, finishing moulds mounted on said finishing carrier, each finishing mould having a finishing mould face, transfer moulds which are mounted in a releasable transfer mould assembly for transfer sequentially from one carrier to the next succeeding carrier in its travel path, each transfer mould having a transfer mould face adapted to cooperate with the input mould face of the input moulds and also with the finishing mould face of the finishing moulds to form mould cavities therebetween in use, each transfer mould having an axis of rotation about which it is rotatable to reorient its transfer mould face with respect to the input and finishing mould faces as required in use, transporting means for transporting said transfer moulds along an endless path which extends around an enclosure, said transporting means comprising a first mould reorienting means serially arranged between the input carrier and the finishing carrier to cause each transfer mould to rotate about its axis of rotation through 180 degrees from a first orientation in which the transfer mould face is directed outwardly of said enclosure when in engagement with said input mould carrier to a second orientation in which the transfer mould face is directed inwardly of said enclosure when in engagement with said finishing mould carrier when transferring a moulded item from the input carrier to the finishing carrier, a second mould reorienting means serially arranged between the finishing carrier and said input carrier to cause each transfer mould to rotate about its axis of rotation through 180 degrees from said second orientation to a third orientation in which the transfer mould face is directed outwardly of said enclosure so as to be correctly oriented for reengagement with said input moulds of said input carrier.

The present invention further provides, in a moulding or finishing machine for moulding or finishing material such as wood pulp to form moulded items, the machine having an input carrier which has a plurality of input moulds mounted thereon, a finishing carrier which has a plurality of finishing moulds mounted thereon and a plurality of transfer moulds adapted to cooperate with the input and finishing moulds to transfer a preform from each input mould to a finishing mould and to remove a finished moulded item from its finishing mould and discharge the finished moulded items into a discharge station, the improvements of; transfer means located between the input carrier and the finishing carrier, the transfer means being operable to sequentially detach each transfer mould from the finishing carrier and thereby release each transfer mould from the finishing mould with which it is mated when attached to the finishing carrier, transport each detached mould away from the finishing carrier into and out of engagement with an input mould of the input carrier and reattach it to the finishing carrier in engagement with a second finishing mould, and means for guiding the movement of and orienting each detached transfer mould into and out of accurate transfer alignment with one of the input moulds and then into and out of accurate transfer alignment with one of the finishing moulds as the detached transfer mould is transported by transfer means. The input carrier and the finishing carrier are mounted on parallel axes for continuous synchronized motion. Each transfer mould is mounted on a transfer mould assembly having an axis of rotation about which it is fully rotatable to orient each transfer mould to face inwardly when cooperating with the finishing mould faces of the finishing moulds on the finishing mould carrier, then reorient the transfer mould face to face outwardly in its travel around on the transfer mould carriers and through a discharge station where the finished products are discharged from the transfer moulds and through an input station where the moulding materials are transferred from the input moulds to the transfer moulds, then reorienting again through 180 degrees in its continuing travel on the transfer carrier towards the finishing carrier, the transfer mould assembly being arranged for sequential transfer to support on releasable mountings on each transporting carrier as it proceeds in continuous motion along an endless path which extends around an enclosure, the endless path comprising travel along a portion of the pressing section of the finishing carrier where the transfer moulds and the finishing moulds are mated together in a pressing function, followed by travel while supported releasably and rotatably on one or more sequentially arranged transfer carriers which extend the path of travel through the point of final product discharge where the finished products are removed from the transfer moulds and through the input station where the empty transfer moulds cooperate with the input moulds to receive moulding material therefrom and thence onward to cooperation of the transfer moulds with the finishing moulds by means of which each individual mould is mated with one matching finishing mould and supported thereon in a pressing operation throughout their travel around together on the finishing carrier. The system of control and orientation of a precise travel pattern provides a shaft at each end of each of the transfer mould assemblies, the shafts beings located along the axis of rotation of the transfer mould assemblies and each of the shafts having mounted thereon a pair of rollers, one of each pair of rollers providing rotatable support in releasable mounts on each of the transporting transfer carriers, while the other one of each pair of the rollers serves as a guide roller, each of the guide rollers travelling along a continuous series of guide tracks whereby to guide the transfer moulds along an optimum travel path for mating in cyclical order and with maximum precision each of the transfer moulds with its matching input mould on the input carrier and with its matching finishing mould on the finishing carrier. Each of the shafts mounted at the ends of each transfer mould assembly is mounted at its outer end with an orienting lever arm, each of the lever arms being fitted with a multiplicity of cam rollers each of which rollers travels intermittently and alternately along cam roller tracks while the transfer mould assemblies are transported sequentially on each of the transporting transfer carriers, the cam rollers cooperating with the cam tracks to provide a precisely controlled optimum continuous orientation program for the transfer moulds as they travel into and out of cooperation alternately with the input moulds on the input mould carrier and the finishing moulds on the finishing mould carrier. The input mould carrier is a rotary input mould carrier wheel and the finishing mould carrier is a rotary finishing mould carrier wheel, each mounted on parallel axes for continuous synchronized motion. The improved transport and orientation system for the transfer mould assemblies may include a transport system for transporting the transfer mould assemblies and their contained transfer moulds back and forth between the input mould carrier wheel and the finishing mould carrier wheel is comprised of a first rotary transfer carrier wheel, a second rotary transfer carrier wheel and a third rotary transfer carrier wheel, the transfer carrier wheels being mounted on axes parallel with each other and with the axes of the input mould carrier wheel and the finishing mould carrier wheel for synchronized continuous motion controlled by a gear train and sequentially arranged to form an endless travel path around an enclosure, the endless path passing continuously along adjoining portions of the circumferences of each of the three rotary transfer carrier wheels and of the finishing mould carrier wheel and making tangential contact between the second transfer carrier wheel and the input carrier wheel, each of the transfer carrier wheels having a multiplicity of radially movable releasable mountings thereon, each of the mountings having a notch to receive one of the pair of shaft mounted rollers at each end of each transfer mould assembly, each of the mountings being urged radially outwardly of the central shafts of the transfer carrier wheels by coiled springs or other means, but limited and retained in its outwardly movement by the resistance of the other roller of the shaft mounted pair rolling along on a guide track located outwardly thereof, the mounting on each of the transfer carrier wheels beings located in parallel but separate planes with the mountings of the next consecutive transfer carrier wheel, and in alternating planes with the guide roller tracks, so that the two rollers of each pair of the shaft mounted rollers may alternate in their functions as supporting rollers and guide rollers as the related transfer mould assembly is transferred from one carrier to another. The orienting system is comprised of:

(i) orienting lever arms fitted on the ends of each of the two shafts mounted at the opposite ends of each transfer mould assembly, with three cam rollers mounted on the outer side of the lever arm at one end of the transfer mould assembly and two cam rollers mounted on the outer side of the lever arm at the other end, the five cam rollers being circumferentially spaced about the axis of rotation of the transfer mould assembly, (ii) a series of arcuate cam track sections located alongside that portion of its travel path where the transfer mould assemblies are transported on the transfer carrier wheels to cooperate sequentially with one or the other of the five cam rollers at one end or the other of the transfer mould assemblies, and (iii) in the pressing system where the finishing moulds are supported on radially movable mountings on the finishing mould carrier wheel, the mountings being urged outwardly of the rotary axis of the finishing mould carrier wheel, slotted guide notches are located adjacent each end of each of the finishing mould mountings to receive the guide rollers mounted on the shafts at each end of the transfer mould assemblies, a set of four locking pins mounted on each of the transfer mould assemblies arranged to cooperate with locking devices movably mounted on the finishing mould carrier wheel, the locking devices being automatically operated to lock each of the transfer mould assemblies in the pressing position as the transfer moulds are mated with the finishing moulds whereby to maintain the transfer moulds in the pressing position while resisting the radially outward force of the pressing action, and subsequently to unlock the transfer mould assemblies as the transfer moulds begin to be unmated from the finishing moulds, each of the transfer mould assemblies being guided in cyclical order into and out of the locking position by the action of the guide rollers travelling along on the guide tracks. The input mould carrier wheel is arranged to rotate into and out of a vat containing moulding materials and to form moulded preforms in the input moulds mounted thereon, a transport and orienting system as previously described is necessary for the transport and orientation of the transfer mould assemblies as they travel back and forth between the input mould carrier wheel and the finishing mould carrier wheel and around on the finishing mould carrier wheel.

The present invention further provides for an extended transport and orienting system comprised of first, second and third rotary transfer carrier wheels and a twin chain conveyor, all mounted on axes parallel with each other and with the axes of the input mould carrier wheel and the finishing mould carrier wheel, the first pair of sprocket wheels of the chain conveyor being located sequentially between the first rotary transfer carrier wheel and the second rotary transfer carrier wheel, a second pair of sprocket wheels being mounted on the shaft of the second rotary transfer carrier wheel, each of the twin chains of the chain conveyor having notched links therealong to form releasable mounts for conducting the transfer mould assemblies along the supporting tracks of the chain conveyor, two sets of three shaft mounted rollers each being provided, one at each end of each of the transfer mould assemblies, a first roller of each of the sets of three rollers being of smaller diameter for releasable mounting in notched links, a second roller of larger diameter in each of the sets of three rollers being arranged to roll along one of the tracks of the chain conveyor, thereby to retain the first roller in place in the notch of the notched link, the third roller of each of the sets travelling along or beside the tracks of the chain conveyor for transfer into the releasable mounts of the second rotary transfer carrier wheel.

The input mould carrier wheel is arranged to rotate in and out of a vat containing moulding materials, from which to form moulded preforms in the input moulds.

The input mould carrier is a rotary input mould carrier wheel and the finishing mould carrier is a rotary finishing mould carrier wheel, each mounted on parallel axes for continuous synchronized motion in an endless path. The improved transport and orienting system for transporting the transfer mould assemblies back and forth between the input mould carrier wheel and the finishing mould carrier wheel comprises:

(a) a rotary transfer carrier wheel mounted on an axis parallel to the axes of the input mould carrier wheel and the finishing mould carrier wheel for synchronized continuous motion controlled by a gear train and (b) a twin chain conveyor with an endless travel path about a pair of sprockets mounted on the central shaft of the transfer carrier wheel and along arcuate chain guide tracks leading from the sprockets to the finishing mould carrier wheel and thence onward on continuing chain guide tracks mounted externally of the circumference of the finishing mould carrier wheel and thence returning along a second pair of arcuate chain guide tracks towards the pair of sprockets on the transfer carrier wheel and the orienting system previously described.

BRIEF DESCRIPTION OF THE DRAWINGS

The invention will be more clearly understood after reference to the following detailed specification read in conjunction with the drawings wherein.

DETAILED DESCRIPTION

Figure 1:
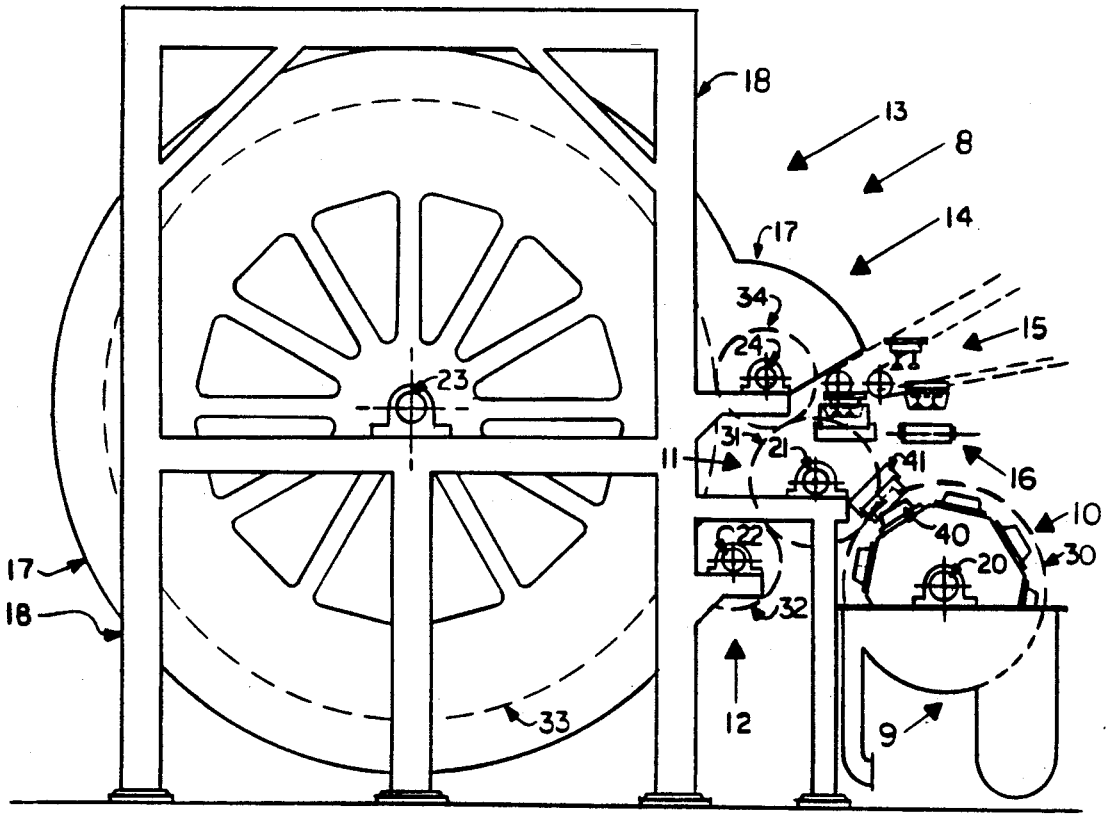
FIG. 1 is a side elevation of a moulding machine constructed in accordance with one embodiment of the present invention, and adapted to the discharge of the finished products by means of a vacuum pick-up system.

With reference to FIG. 1 of the drawings, the numeral 8 refers generally to a moulding machine constructed in accordance with an embodiment of the present invention. The moulding machine 8 comprises an input carrier 10, a finishing carrier 13, a first rotary transfer carrier 11, a second rotary transfer carrier 12, a third rotary transfer carrier 14 and a multiplicity of transfer mould assemblies 19. The input carrier 10 rotates through the forming vat 9, and acts as a vacuum former on which preform moulded items are formed in a well known manner.

Figure 5:
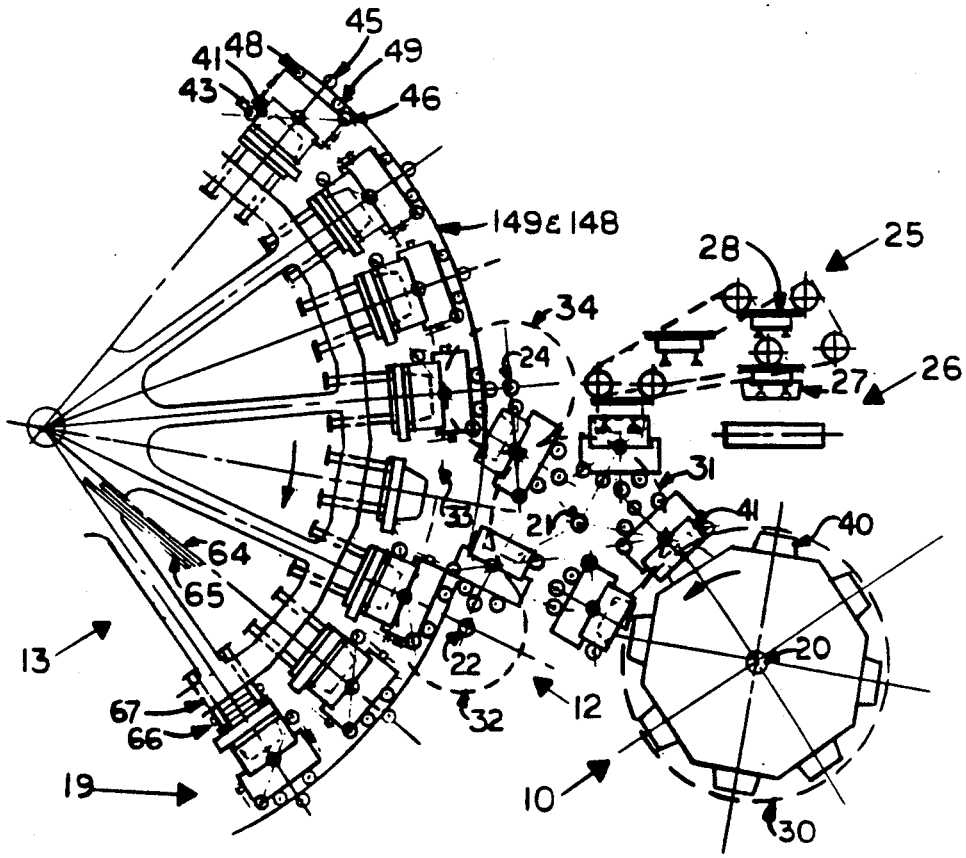
FIG. 5 is an internal longitudinal vertical section of a portion of the machine of FIG. 1, showing in more detail the input carrier, the finishing carrier, the first, second and third transfer carrier, and the related vacuum pick-up discharge system.

Referring to FIG. 5 the first rotary transfer carrier 11 transfers the transfer mould assemblies 19 with their contained moulded preforms to the second rotary transfer carrier which in turn transfers the transfer mould assemblies and their contained preforms to support and travel around on the finishing carrier. The third rotary transfer carrier transfers the transfer mould assemblies 19 and the contained finished items from the finishing carrier to the first rotary carrier 11, which in turn carries the transfer mould assemblies 19 through the discharge point of cooperation with the vacuum pickup assembly 15 where the finished products 27 are discharged serially on the the belt conveyor 26. The operation of the vacuum pickup is well known in the industry, and will not be described here. The transfer mould assemblies 19, with the finished products 27 having been removed therefrom, continue around on the first transfer carrier 11 once again to the point of cooperation with the input moulds 40 on the input carrier 10. The finishing process being performed between the transfer moulds 41 and the finishing moulds 42 when mated on the finishing carrier 13 may comprise pressing a previously dried preform with one or both moulds heated to achieve permanent densification and a smoother surface, or pressing a wet moulded preform with unheated moulds to achieve partial densification, partial dewatering and a smoother surface, or pressing a wet moulded preform with one or both moulds heated to achieve improved densification, with partial dewatering by pressing and further drying by evaporation. Removal of moisture pressed or evaporated from the moulded product is effected by the application of vacuum internally of the moulds in a manner well known to the industry.

The input carrier 11 of the machien of FIG. 1 is an input mould carrier wheel comprising a rotary drum 124 mounted for rotation about shaft 20. In a wet forming operation the lower segment of said rotary drum extends into a pulp vat 9. A plurality of forming moulds 40 are mounted at circumferentially spaced intervals about the drum 124, and are arranged to pass sequentially through the vat 9. A gear wheel 30 is mounted on the shaft 20 and serves to drive the rotary drum 124 in synchronized rotation with the finishing carrier 13. The first transfer carrier 11 is mounted for rotation about shaft 21 in bearings supported on the frame 18. In the embodiment illustrated in FIG. 5 the second transfer carrier 12 is mounted for rotation on shaft 22 which is supported in bearings mounted on frame 18, and the third transfer carrier 14 is mounted for rotation on shaft 24 which is supported in bearings mounted on frame 18.

Figure 6:
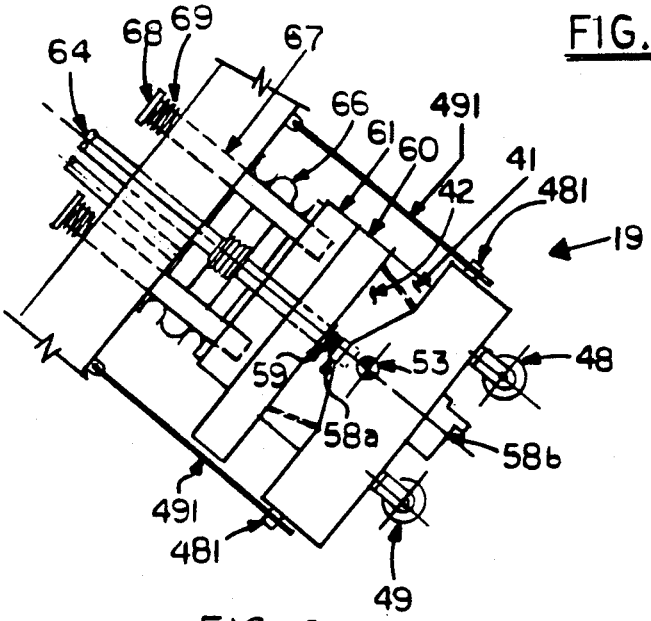
FIG. 6 is an end view of a transfer mould assembly mated with a finishing mould assembly, with the lever arm of the transfer mould assembly removed.
Figure 7:
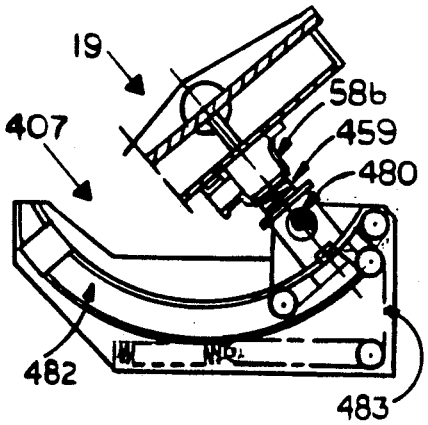
FIG. 7 is a diagram showing the valves of a transfer mould assembly and a transfer carrier mated together.
Figure 8:
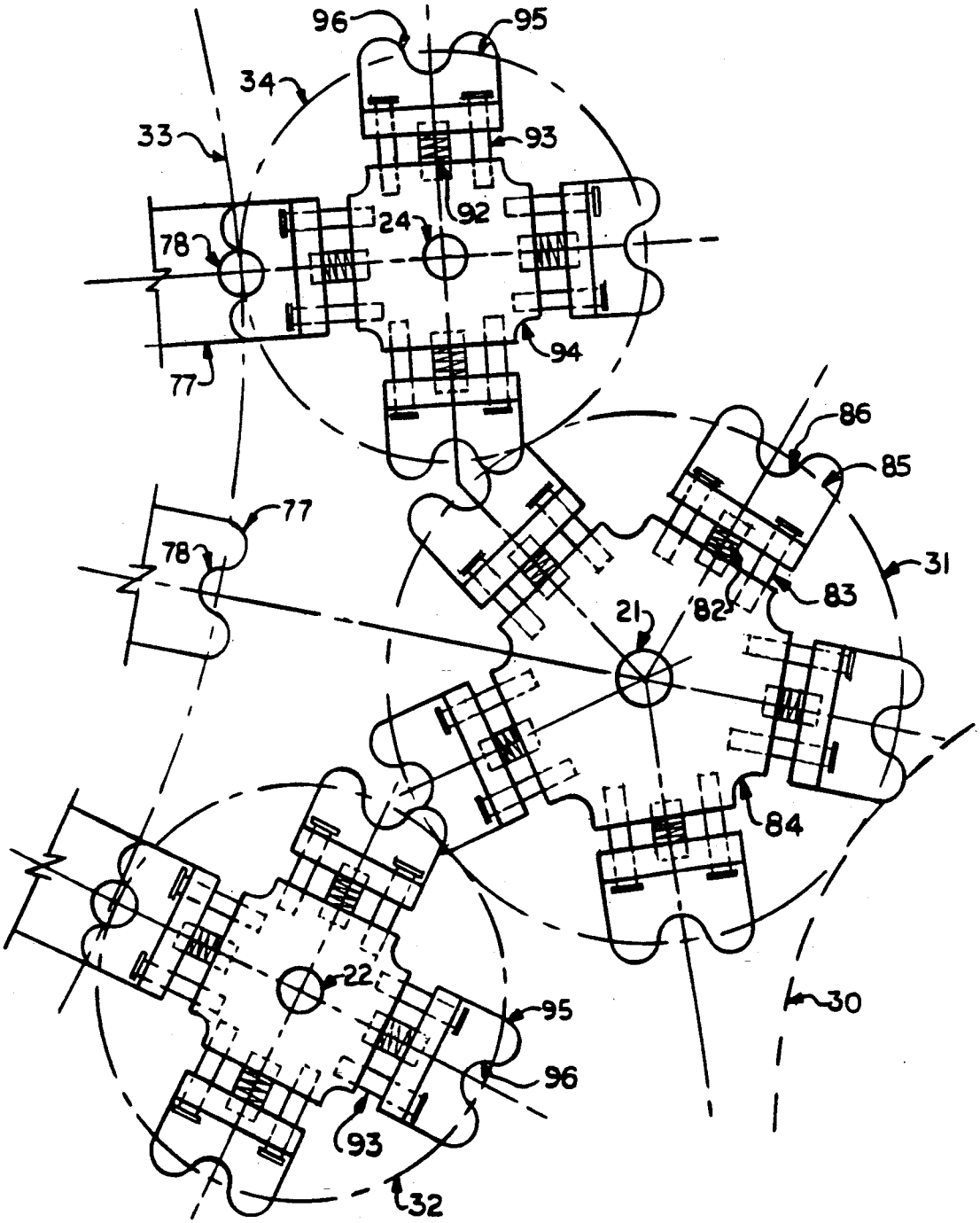
FIG. 8 is a diagram of the first, second and third transfer carriers of the machine of FIG. 1, with all of the moulds and the transfer mould assemblies removed, to show more clearly their relationship with each other and with the input carrier and the finishing carrier.
Figure 9:
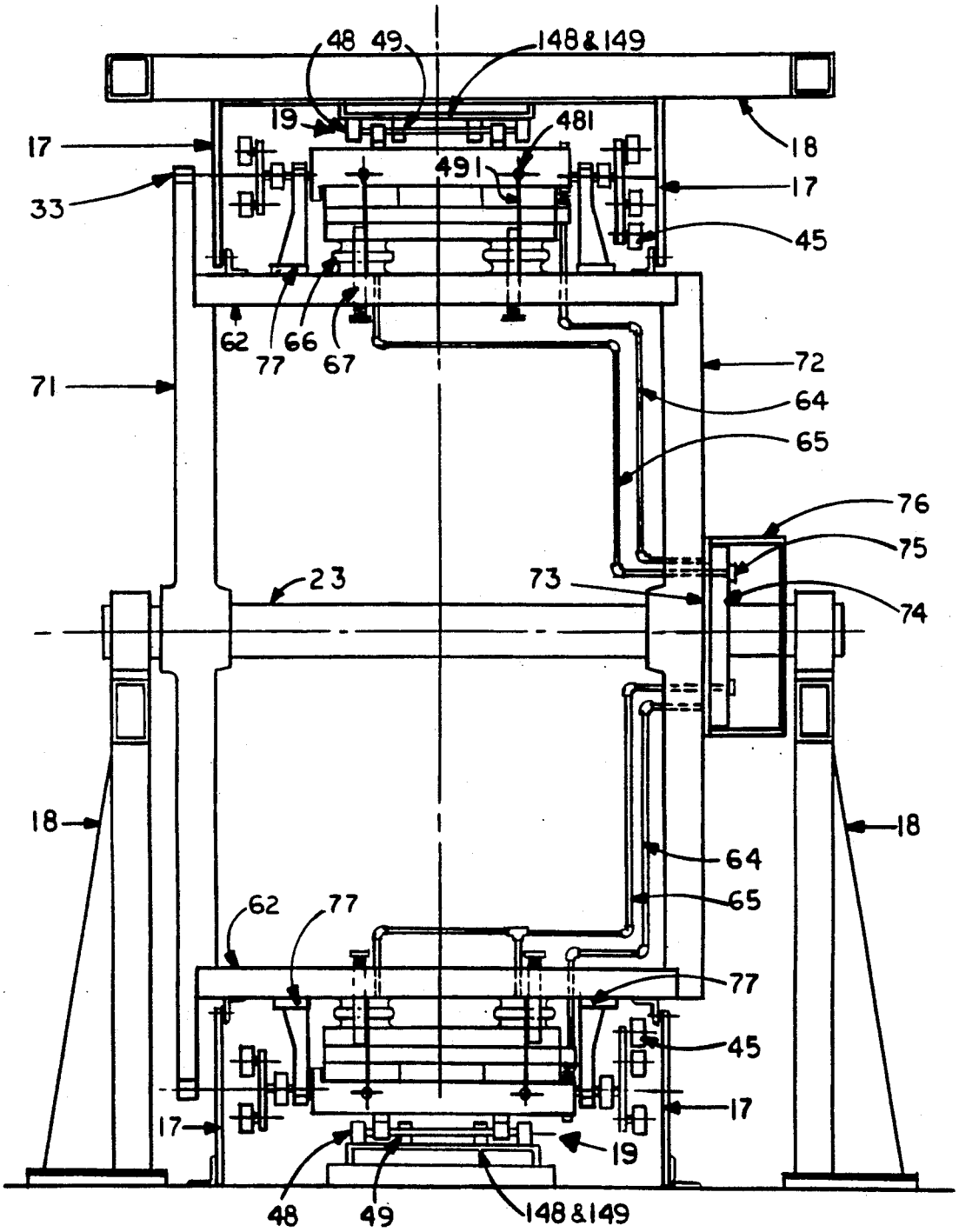
FIG. 9 is a transverse vertical section of the machine of FIG. 1
Figure 17:
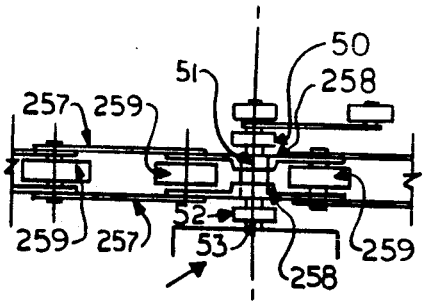
FIG. 17 is a plan view of a portion of one of the two carrier chains of the chain conveyor showing the relationship of said chain with the rollers mounted on the principal shafts of the transfer mould assembly of FIG. 15.
Figure 19:
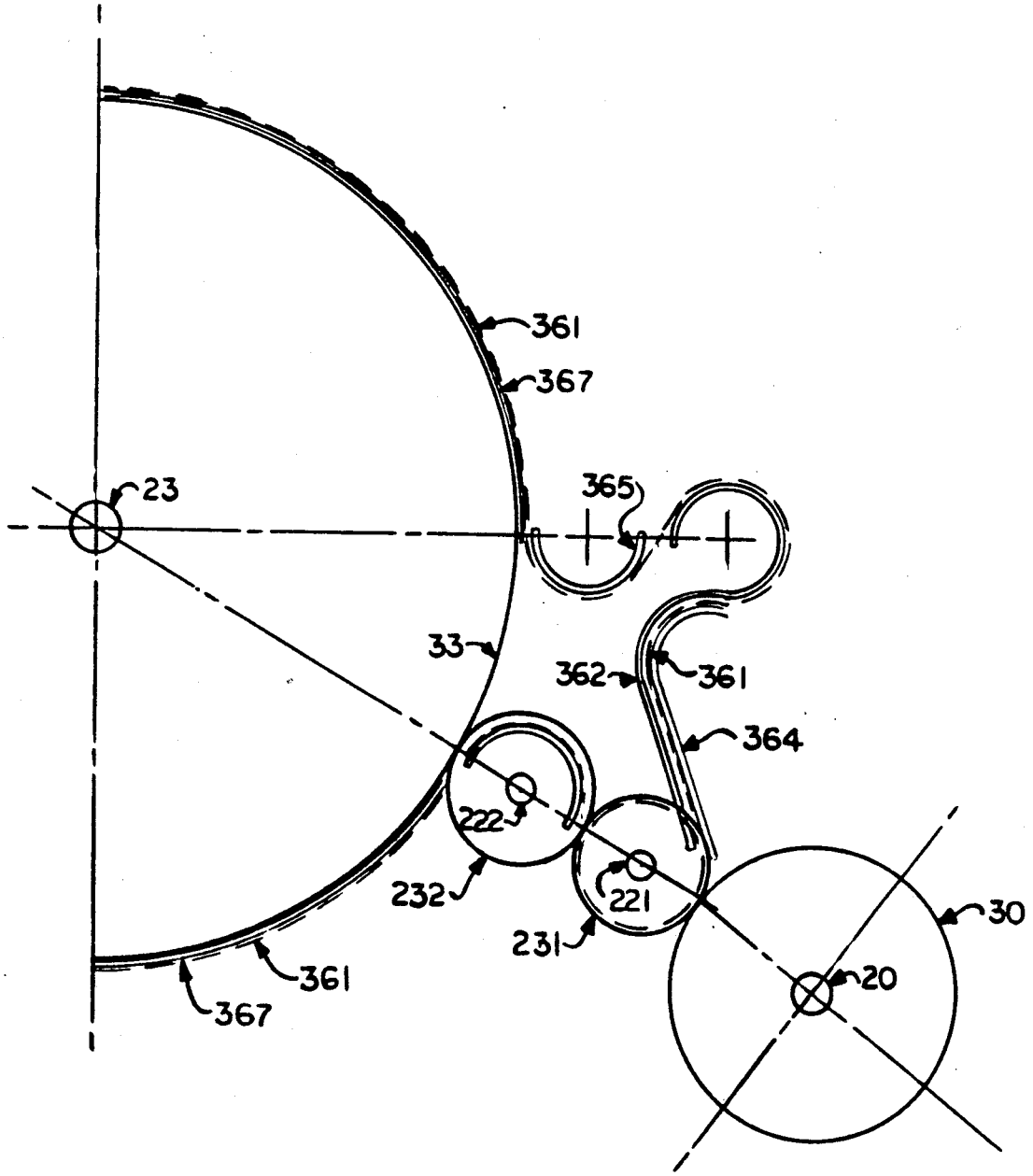
FIG. 19 is a diagram illustrating an alternative gear train of the machine of FIG. 12 using a chain conveyor which travels freely about the finishing carrier and externally of the circumference thereof, and then transports the transfer mould assemblies in cyclical order from the finishing carrier through the product discharge station, and through the preform input station at the input carrier, and thence onward to the finishing carrier, at which point the transfer mould mould assemblies are released and mated with the finishing moulds and are supported thereon in their travel path around the finishing carrier.

The input carrier 10 and the finishing carrier 13 are each supplied with facilities for the controlled application of vacuum and compressed air to each of the moulds which they support, the means of supply comprising connecting piping 64 leading from a rotary valve mounted on each of their principal shafts as shown in FIG. 6 and FIG. 8, in a manner which is well known in the industry and therefore will not be described here in detail. Vacuum and compressed air as required in use are supplied to the transfer moulds 41 while supported on the finishing moulds 42 of the finishing carrier 13 through the connecting valves 58*a* and 59 as shown in FIG. 6, and by connecting valves 58*b* and 459 as shown in FIG. 17 when supported on one of the transfer carriers 11, 12 or 14. The finishing carrier also has facilities for the controlled application of compressed air at a higher pressure level to a plurality of airmounts 66 through connecting piping 65.

The relationship of the radially moveable mounts 85 on transfer carrier 11 and 95 on transfer carriers 12 and 14 to each other and to the guide mounts 77 on the finishing carrier is shown in FIG. 8, the mounts 85 of transfer carrier 11 and the mounts 77 of finishing carrier 13 being arranged in one plane to receive in cyclical order the rollers 52 of the transfer mould assembly 19 in the arcuate supporting notches 86 of said mounts 85, and in the slotted guide notches 78 of fixedly supported mounts 77 to serve in alternate order with the mounts 95 of transfer carriers 12 and 14 located in a separate but parallel plane to support the rollers 50 on said transfer mould assemblies 19 in the arcuate support notches 96 of said mounts 95, said notches 86 and notches 96 providing continuous support in sequential order to said transfer mould assemblies 19 as they proceed along an endless travel path back and forth between said finishing carrier 13 and the input carrier 11, and then onward around the circumference of said finishing carrier while supported on the finishing moulds 42 thereof, and guided in the radial movement of the pressing action by the slotted notches 78 of the mounts 77. Also shown in FIG. 8 are the pitch lines of a gear train comprised of gear 30, gear 31, gear 32, gear 33 and gear 34, to form a base line moving in synchronized continuous motion along the travel path of said transfer mould assemblies to coordinate the sequential transfer of said transfer mould assemblies from the notches of one supporting carrier to the notches of the next supporting carrier along said travel path.

Figure 12:
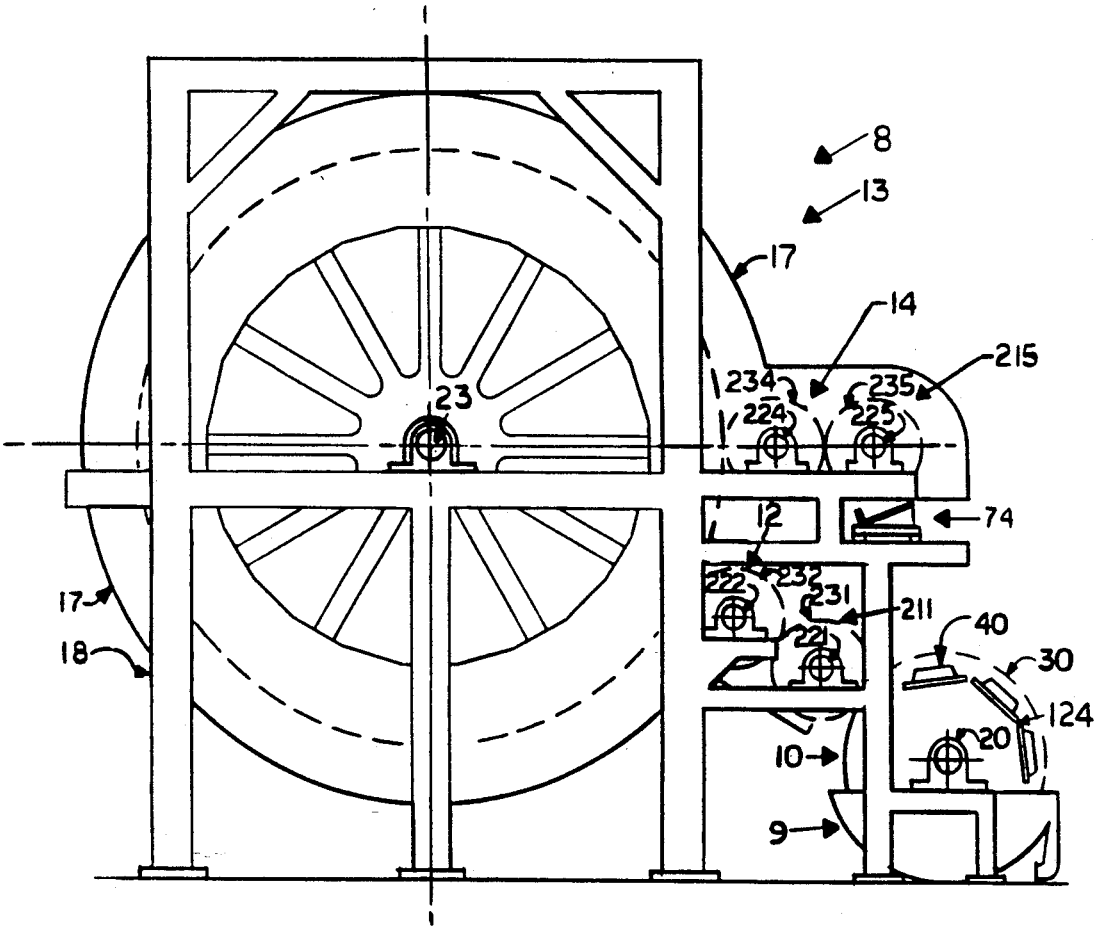
FIG. 12 is a side elevation of a moulding machine constructed in a second embodiment, wherein the transport system has been extended by the addition of a chain conveyor to facilitate the discharge of the finished products by drop-off directly on to a belt conveyor.
Figure 13:
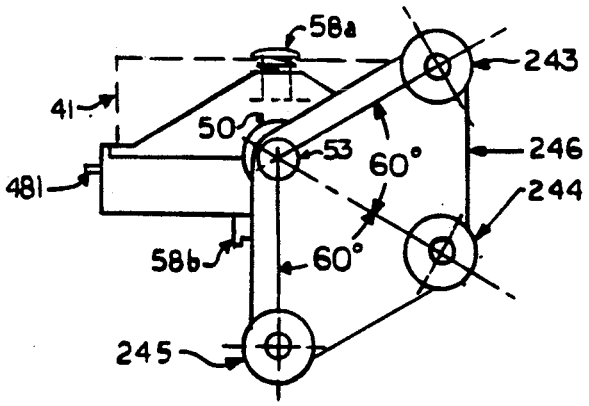
FIG. 13 is an end view of one end of a transfer mould assembly showing an alternative and simplified cam follower arrangement made possible by the extended transport system of FIG. 12.
Figure 14:
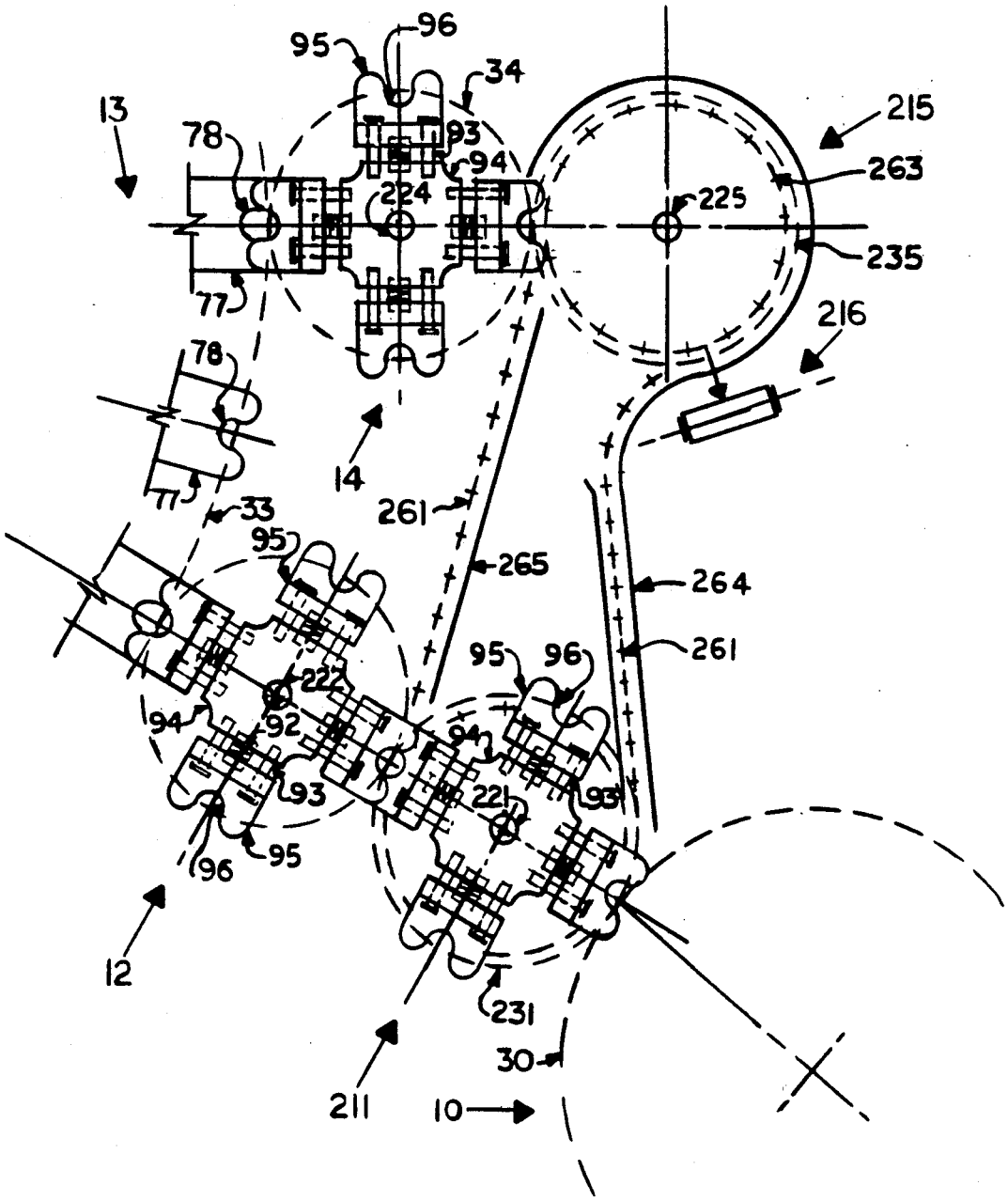
FIG. 14 is a diagram of the first, second and third transfer carriers of the machine of FIG. 12, showing the extended travel path of the transfer mould assemblies about a chain conveyor, and the location of the drop-off discharge point for the finished products.
Figure 15:
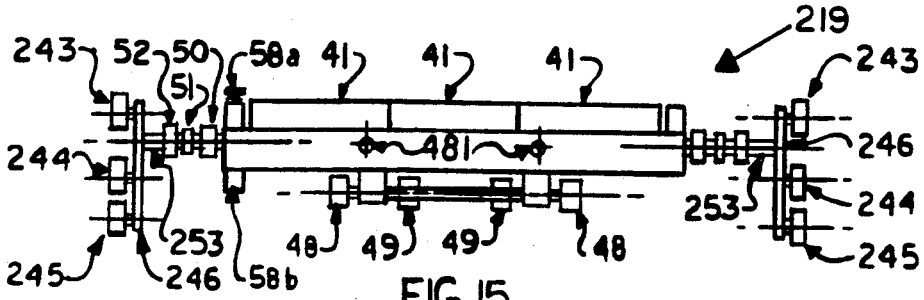
FIG. 15 is a side view of a transfer mould assembly fitted with additional shaft mounted rollers for transport on the chain conveyor of the moulding machine of FIG. 12 as will be explained later.
Figure 16:
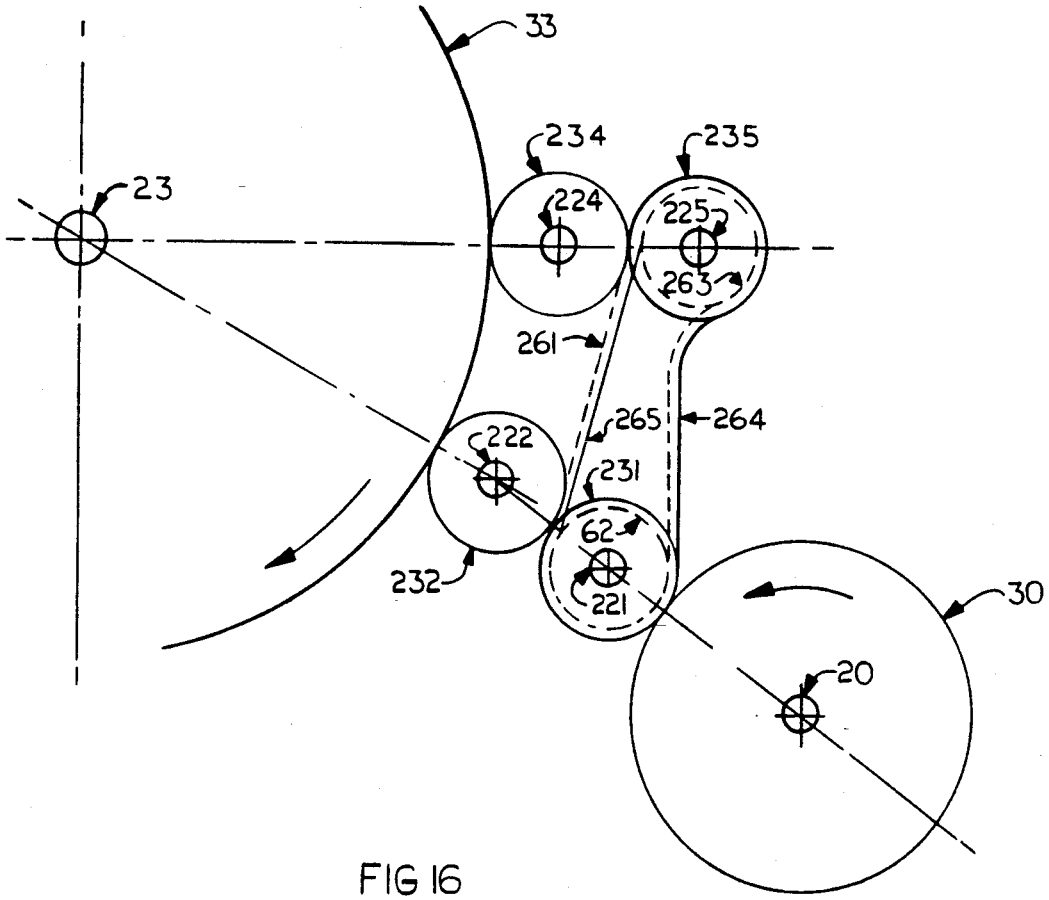
FIG. 16 is a diagram illustrating the gear train of the machine of FIG. 12 mounted with a supplementary chain conveyor.
Figure 18:
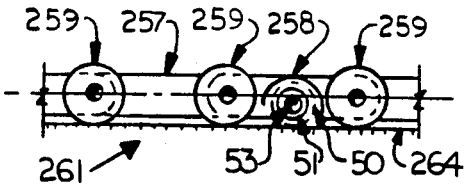
FIG. 18 is a side view of the chain of FIG. 17.

FIG. 14 is a diagram similar to the diagram of FIG. 8, to illustrate the relationship of the four transfer carriers of the moulding machine of FIG. 12 wherein the travel path of the transfer mould assemblies 19 is extended in length by means of a twin chain conveyor 215 interposed between transfer carrier 14 and transfer carrier 211 in order to provide sufficient additional space along said travel path for one or more different or additional functions, said conveyor 215 being comprised of two endless conveyor chains 261 travelling in parallel along twin tracks 264 and 265 and continuing around on two sprockets 262 and two sprockets 263, each of said chains being supplied with links 258, said links having notches adapted to receive the rollers 51 of transfer mould assembly 219, as shown in FIG. 17 and FIG. 18, said sprockets 262 being mounted concentrically with gear 231 on the shaft 221 of transfer carrier 211, said sprockets 263 of said conveyor 215 being mounted concentrically with gear 235 on shaft 225, said sprockets 262 and sprockets 263 of said conveyor 215 being synchronized in continuous rotary motion with input carrier 10, transfer carrier 211, transfer carrier 12, finishing carrier 13, and transfer carrier 14 by means of the gear train comprised of their respective gears 30, 231, 32, 34 and 235, the mounts 85 of transfer carrier 211 and the mounts 77 of finishing carrier 13 being arranged in two first planes to receive the rollers 52 of the transfer mould assemblies 219, the mounts 95 of said transfer carriers 12 and 14 beign arranged in a second pair of parallel planes to receive the rollers 50 of said transfer mould assemblies 219, and the travel paths of said chains 261 of said conveyor 215 being arranged in a third pair of parallel planes to receive in cyclical order in the notches of said links 258 the rollers 51 of the transfer mould assemblies 219, the tracks 264 of said conveyor 215 being of sufficient width and located to receive both the chain rollers 259 and the rollers 50 of the transfer mould assemblies 219, said rollers 51 being retained in the notches of said links 258 by the action of said rollers 50 rolling along on said tracks 264 and said transfer mould assemblies 219 being urged along in their travel path by the rollers 51 mounted releaseably in the notches of said links 258 of said continuously moving conveyor chains 261.

Figure 11:
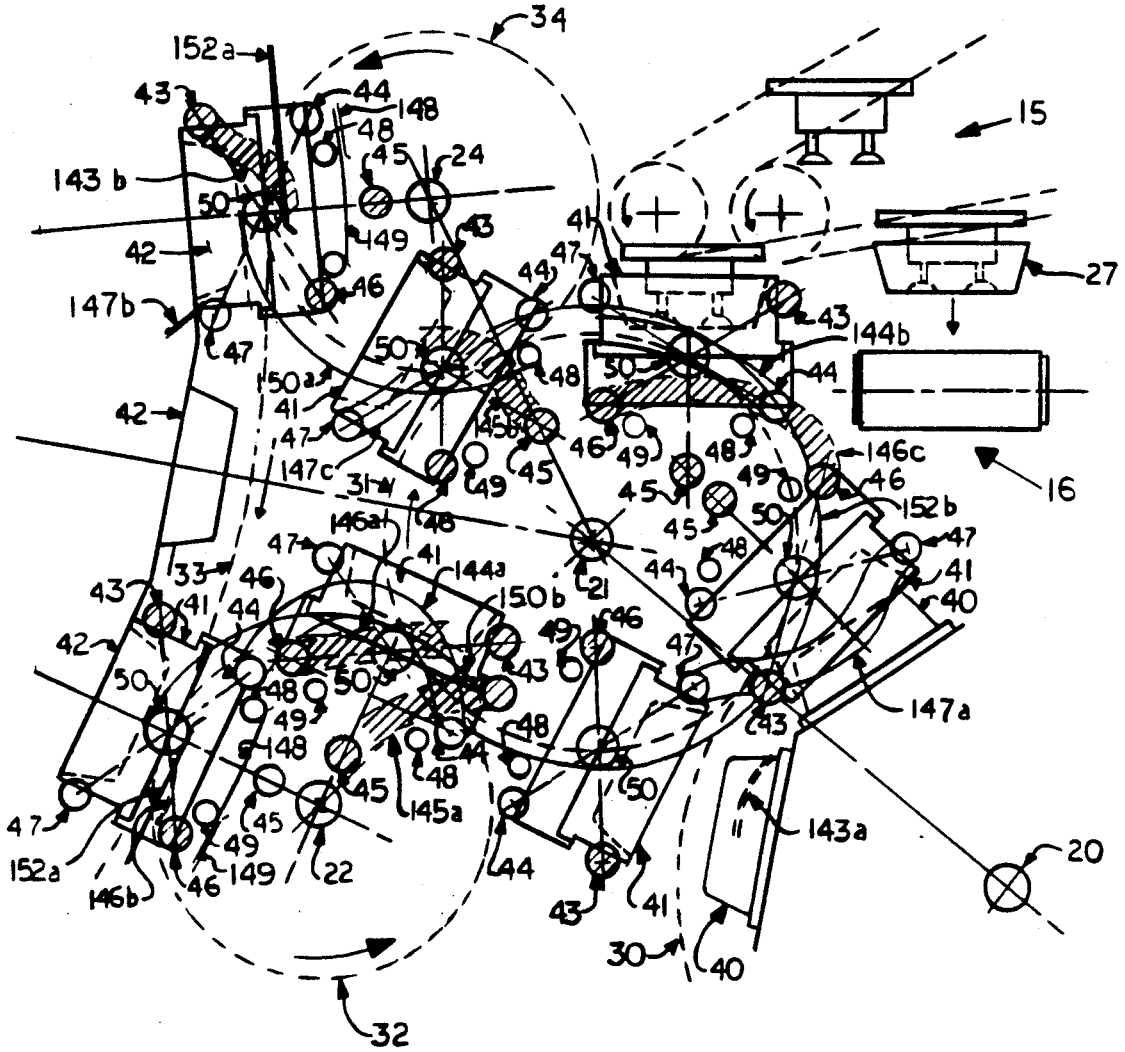
FIG. 11 is a diagram of the various cam tracks for use with the cam rollers and followers of machine of FIG. 1 for guiding and orienting the transfer mould assemblies in their travel path from the finishing carrier and through the discharge and input stations and back to their support on the finishing moulds of the finishing carrier.

FIG. 11 is a diagram illustrating the control system of the moulding machine of FIG. 1 by means of which the travel path and the orientation program of the transfer mould assemblies 19 are precisely determined at all locations. Each of the transfer mould assemblies 19 is mounted with 4 locking pins 48 arranged to cooperate with automatically operated locking devices 49 moveably mounted on the finishing mould carrier 13 whereby to lock each of said transfer mould assemblies 19 in the pressing position as the transfer moulds 41 are mated with the finishing moulds 42 and thereby to maintain said transfer moulds 41 in the pressing position while resisting the radially outward force of the pressing action, and subsequently to unlock said transfer mould assemblies 19 as the transfer moulds 41 begin to be unmated from the finishing moulds 42, each of the transfer mould assemblies 19 being guided in cyclical order into and out of the locking position by the action of said guide rollers 52 travelling along on guide tracks 152*a*. The total pressure loading exerted upon the preforms between the mated moulds 41 and 42 on the finishing carrier 13 which must be supported by each transfer mould assembly 19 will vary with the total active area of the moulds 41 mounted thereon and the level of pressure per unit of that area required by the finishing process of a particular production line. The selection and design if a locking mechanism as exemplifiedd by the 4 locking pins 481 and the 4 locking arms 491 shown on FIG. 6 and the location and use of the 4 auxiliary load carrying wheels 48 and 49 and their related tracks 148 and 149 as a supplementary or alternative method of supporting the said transfer mould assembly 19 and the moulds 41 mounted thereon in their pressing relationship with their mated moulds 42 as they travel around on the finishing carrier 13 is therefore a matter of conventional design to meet the requirements of said production line and need not be further described here. In their travel about sequentially on the transfer carriers, said transfer mould assemblies are supported releaseably by rollers 50 supported on the notches 96 of the mounts 95 of transfer carrier 14, by rollers 52 supported on the notches 86 of the mounts 85 of the carrier 11, and by rollers 50 supported on the notches 96 of the mounts 95 of the transfer carrier 12, each of said transfer mould assemblies 19 being guided in its travel path by the action of said rollers 50 rolling along on tracks 150*a* and 150*b* alternating with said rollers 52 along tracks 152. By means of this mechanism, said transfer mould assemblies 19 and the transfer moulds 41 supported thereon are guided into and out of a regular circular path, in order to follow an optimum path into and out of cooperation with the input moulds 40 on the input carrier and with the finishing moulds on the finishing carrier for interference free entry into deep products as prescribed in said U.S. Pat. No. 3,661,707 issued to Emery and Emery. The precision of control is enhanced by the novel location of said guide tracks 150*a*, 152 and 150*b* at greater distances radially outward of the centres of rotation of said transfer carriers 11, 12 and 14, and tangent to said rollers 50 and 52 at the portion of their peripheries most radially distant outward of said centres of rotation, instead of at the inward portion thereof, as described for the transfer mechanism of said U.S. Pat. No. 3,661,707.

Figure 2:
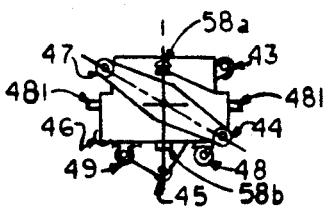
FIG. 2 is an end view at one end of a transfer mould assembly adapted to the moulding machine of FIG. 1.
Figure 3:
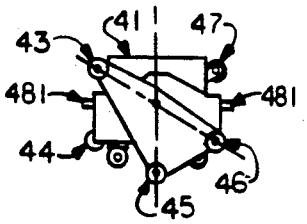
FIG. 3 is an end view at the other end of the transfer mould assembly of FIG. 2.
Figure 4:
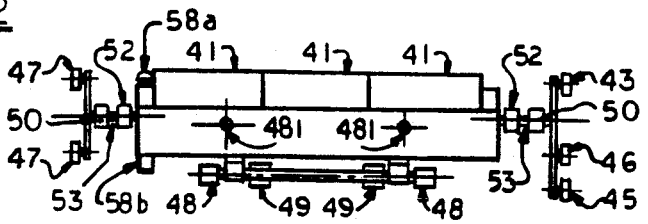
FIG. 4 is a side view of the transfer mould assembly of FIG. 2.
Figure 10:
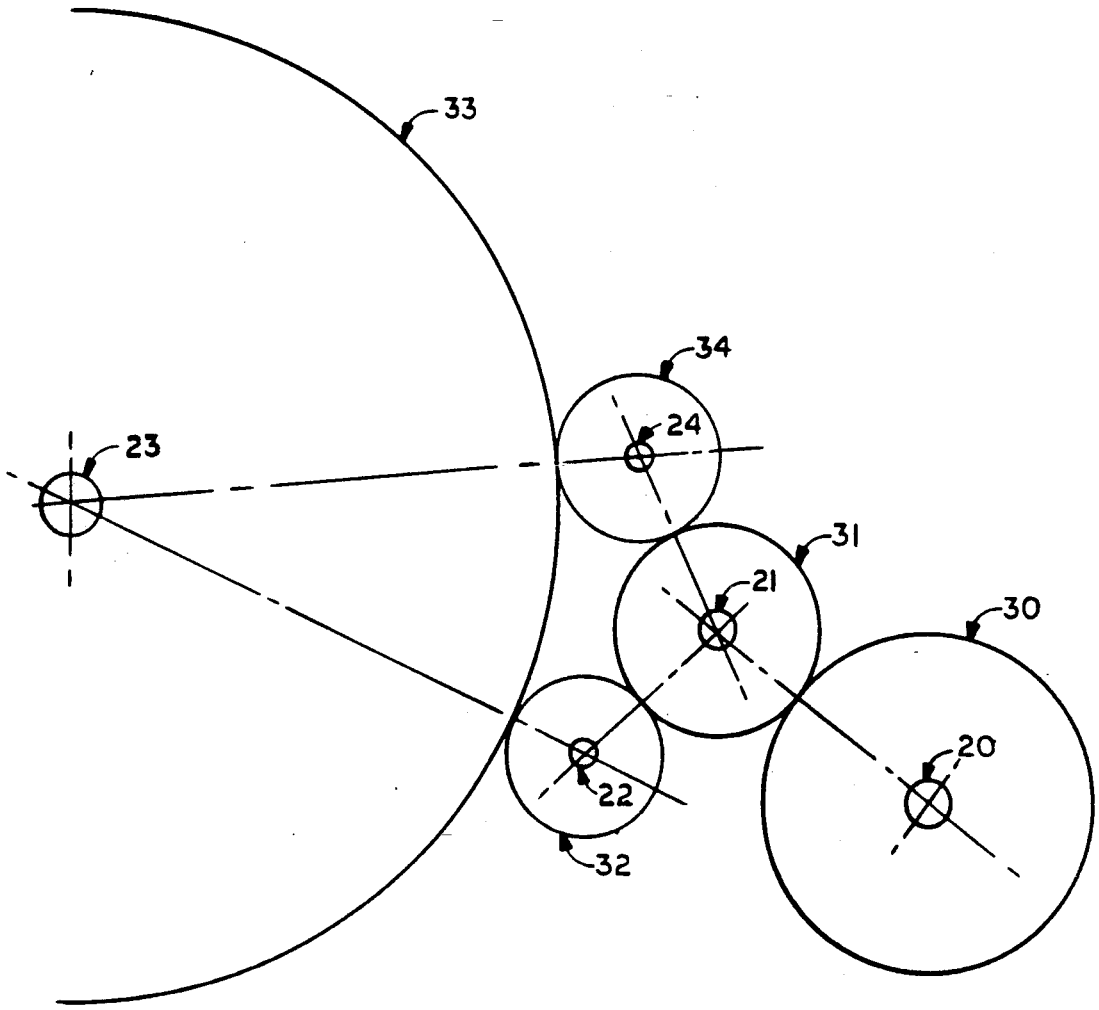
FIG. 10 is a diagram illustrating the gear train which synchronizes the rotary motions of the machine of FIG. 1

The orientation control system of the machine of FIG. 1 is provided with 5 cam followers, circumferentially spaced at intervals of 60 degrees around a sector of 240 degrees, and mounted on lever arms at each end of each of the transfer mould assemblies 19, as illustrated in FIG. 2 and FIG. 3, thereby to provide for a rotation of 180 degrees in cooperation with their respective cam tracks as they travel between the input carrier and the finishing carrier. As shown in FIG. 10, the orientation program begins as the transfer moulds 40 supported on the transfer mould assembly 19 are separated from the finishing moulds 42 supported on the finishing carrier 13 immediately following the finishing oeprations on said finishing carrier, the rollers 48 and 49 being released from tracks 148 and 149 respectively as the guide wheels 50 are directed to guide track 150*a*, the cam follower 43 enters cam track 143*b*, and the cam follower 47 is directed against cam track 147*b*. As the cam follower 43 leaves cam track 143*b* the cam follower 45 enters cam track 145*b* which terminates as cam follower 47 enters a short section of cam track 147*c*. As cam follower 47 leaves cam track 147*c*, cam follower 46 enters cam track 146*c*, which terminates as cam follower 47 enters cam track 147*a*. As cam follower 47 leaves cam track 147*a* cam follower 45 enters cam track 145*a* which terminates as cam follower 46 enters track 146*a*. The transfer mould assembly 19 and the transfer moulds 41 supported thereon are then directed into cooperation with the finishing moulds 42 supported on the finishing carrier 13, the cam follower 46 having left the track 146, and said transfer mould assembly being oriented into position on the finishing carrier with cma follower 44 travelling in cam track 144*a*, and cam follower 46 directed against cam track 146*b*.

Figure 20:
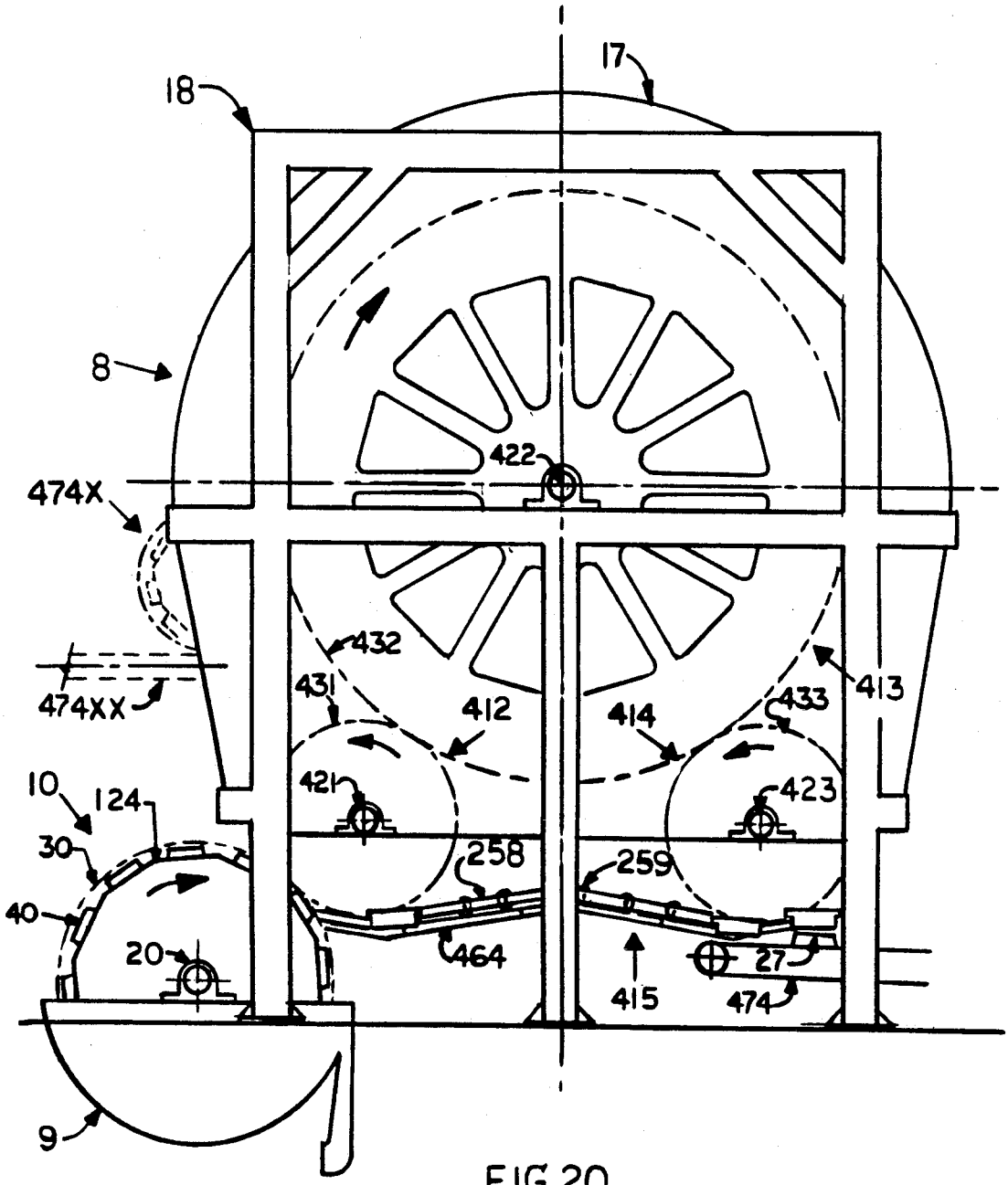
FIG. 20 is a side elevation of a moulding machine constructed in a third embodiment, comprising a simplified orientation program and a major extension of a chain conveyor serving as a supplementary transfer carrier and providing additional length of travel for alternate locations for discharge of the finished products, and for additional finishing functions such as printing and after drying.
Figure 21:
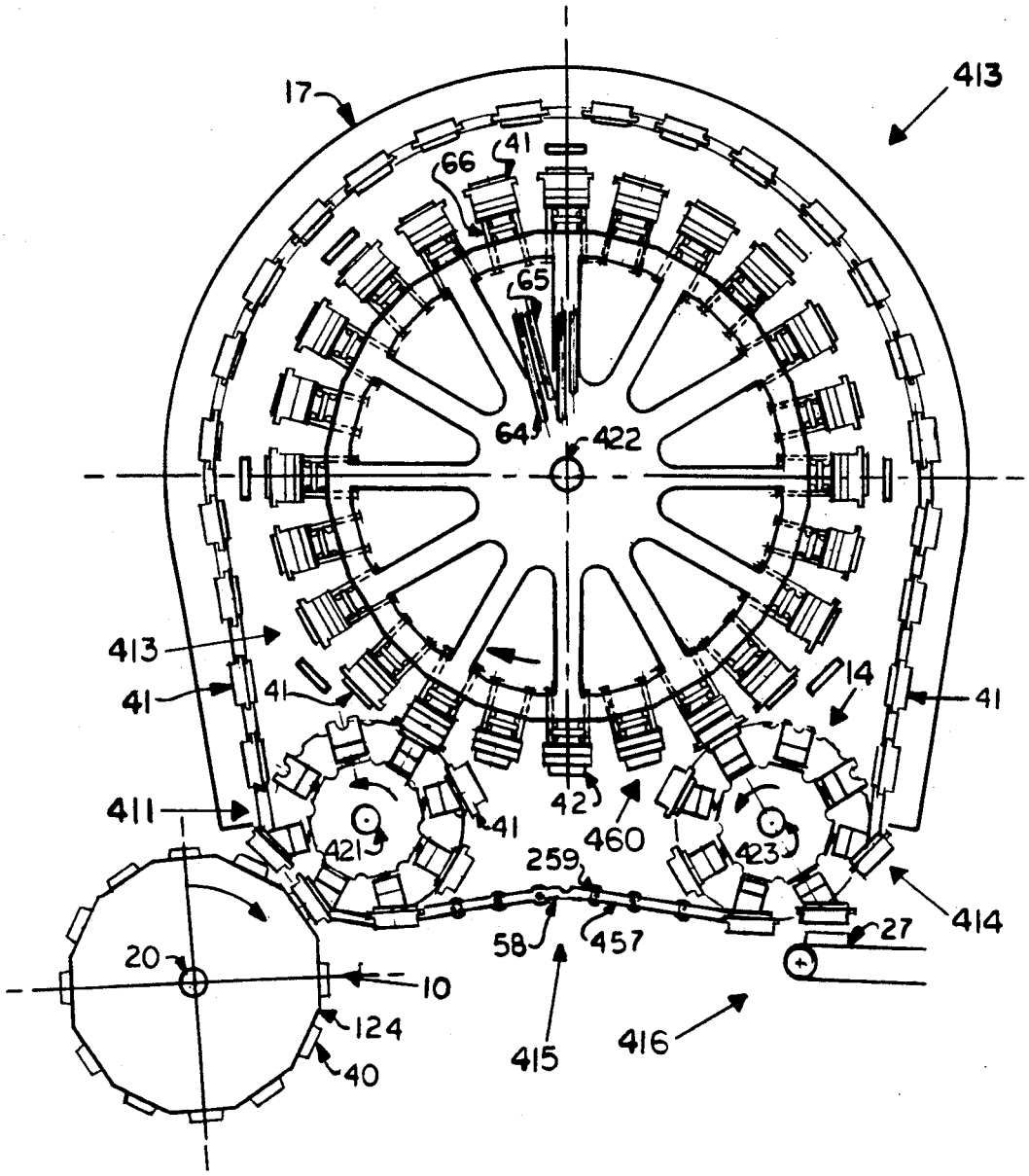
FIG. 21 is an internal longitudinal section of the moulding machine of FIG. 20 showing the extended travel path of the chain conveyor.
Figure 22:
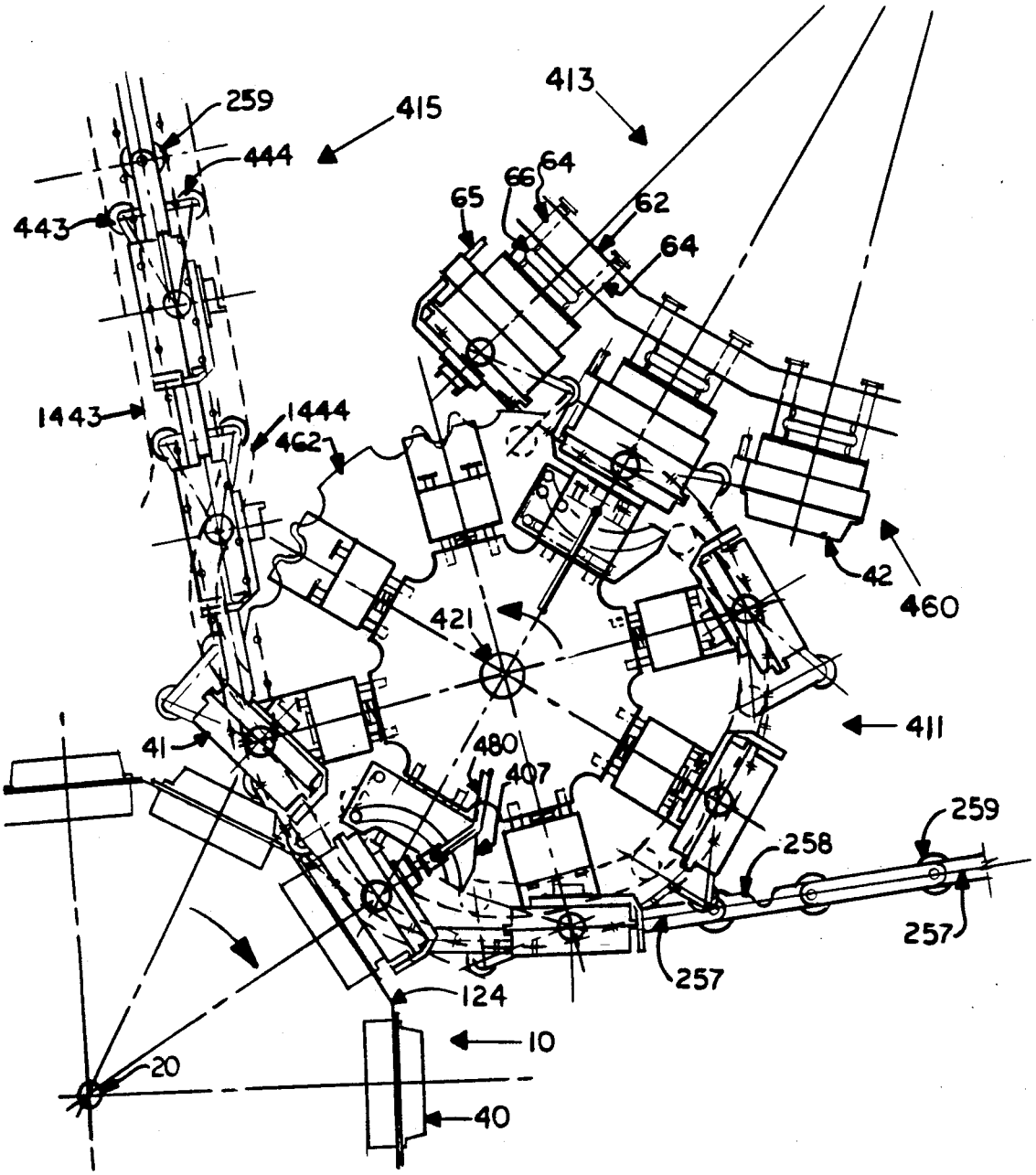
FIG. 22 is a diagram showing in more detail the relationship of the chain conveyor and one of it spockets with the input carrier, the first transfer carrier, and the finishing carrier, and also showing a typical valve connection between a transfer mould assembly and a transfer carrier. The arrangement of the transfer carrier 14 is similar and will not be described further here.

This invention is not limited in its application to the configuration described herein for the moulding or finishing machines of FIG. 1, FIG. 12 or FIG. 20 because the concept of releaseably mounted and freely transferable transfer mould assemblies provides the opportunity of extending the length and changing the configuration of said travel path by including therealong additional transfer carrier wheels or chain conveyors, or by changing the length or configuration or arrangement in sequence thereof, and by the addition of an alternating series of transfer carriers in order to present any face of the product at any point in its travel path to facilities for printing, labelling, laminating, post forming or post drying in a continuous production line and in continuous motion through as may be required to produce the desired final product.

What I claim as my invention is:

1. A mould transfer mechanism in combination with and for a precision moulding or finishing system including a finishing process for providing moulded products, said system having an input mould carrier mounted on axes parallel with and rotating in synchronized continuous motion with a finishing mould carrier and one or more transfer mould carriers, with input moulds mounted on said input mould carrier each input mould having an input face to contain and present a moulded preform for transfer, and with finishing moulds mounted on said finishing mould carrier each finishing mould having a finishing face to function as one of a pair of finishing moulds in a finishing opertion between a pair of pressing moulds, said transfer mechanism comprising:

(a) a multiplicity of dual purpose transfer moulds mounted singly or in groups on a series of transfer mould assemblies, and (b) one or more transfer mould carriers to transport said transfer moulds sequentially and in uninterrupted continuous motion on an endless path from tangential contact with said input moulds on said input mould carrier to pick up and contain said moulded preforms for transport to and around on said finishing mould carrier to mate at said finishing mould carrier with the finishing moulds mounted thereon, each transfer mould functioning at said finishing mould carrier as one of a pair of finishing moulds which remain together throughout the finishing process, after which said transfer moulds are transferred while still mounted on the said transfer mould assemblies and still containing said moulded products now in finished condition, from said finishing mould carrier to a transfer mould carrier, thereby being unmated from the finishing moulds mounted on said finishing mould carrier, and travelling thenceforward through a point where said moulded products are discharged and thereafter the transfer moulds being empty, travelling onward to tangential contact once more, all in continuous motion and in continuing repetition of an input, finishing and discharge sequence, and (c) a system of control to generate a precise travel path and orientation program wherein each said transfer mould assembly has an axis of rotation about which it is fully rotatable as required for said transfer moulds supported thereon, to face outwardly of their endless travel path loop when cooperating with said input moulds mounted on said input mould carrier, to then face inwardly of said travel path loop when cooperating with said finishing moulds on said finishing mould carrier, and to then face outwardly again while said transfer mould assemblies with said transfer moulds mounted thereon are passing through a discharge station, each of said transfer mould assemblies having a shaft at each end, said shafts being located along the axis of rotation of said transfer mould assemblies, each of said shafts having mounted thereon a pair of rollers, one of each said pair of rollers providing rotatable support in releasable mounts on each of said transfer mould carriers, while the other one of each said pair of rollers serves as a guide roller, each of said guide rollers travelling along a continuous series of parallel guide tracks so as to guide said transfer mould assemblies along an optimum travel path so as to cooperate in cyclical order and with maximum precision with each of said transfer moulds with a matching input mould on said input mould carrier and with a matching finishing mould on said finishing mould carrier, and wherein each of said shafts mounted at the ends of each transfer mould assemblies is mounted at its outer end with an orienting lever arm, each of said lever arms being fitted with a multiplicity of cam rollers each of which cam rollers travels intermittently and alternatively along cam roller tracks while said transfer mould assemblies are transported sequentially on each of said transfer mould carriers, said cam rollers cooperating with said cam roller tracks to provide a precisely controlled optimum continuous orientation program for said transfer moulds as they travel into and out of cooperation alternatively with said input moulds on said input mould carrier and with said finishing moulds on said finishing mould carrier.

2. The mould transfer mechanism of claim 1, wherein said input mould carrier is a rotary input mould carrier wheel and said finishing mould carrier is a rotary finishing mould carrier wheel, each mounted on parallel axes for continuous synchronized motion, including a transport and orientation system for said transfer mould assemblies wherein:

(a) said transport system transport back and forth said transfer mould assemblies and the transfer moulds contained thereon between said input mould carrier wheel and said finishing mould carrier wheel and including a first rotary transfer carrier wheel, a second rotary transfer carrier wheel and a third rotary transfer carrier wheel, said first, second and third rotary transfer carrier wheels being mounted on axes parallel with each other and with said axes of said input mould carrier wheel and said finishing mould carrier wheel for synchronized continuous motion controlled by a gear train and sequentially arranged to form an endless travel path loop, said endless path passing continuously along adjoining portions of the circumferences of each of said three rotary transfer carrier wheels and of said finishing mould carrier wheel and making tangential contact between said second rotary transfer carrier wheel and said input carrier wheel, each of said transfer carrier wheels having a multiplicity of radially moveable releasable mountings thereon, each of said mountings having a notch to receive one of said pair of rollers mounted on said shafts at each end of each transfer mould assembly, each of said mountings being urged radially outwardly from said transfer carrier wheels by means yet limited and retained in its outwardly movement by the resistance of the other roller of said pair of rollers mounted on said shafts rolling along on a guide track located outwardly thereof, said mounting on each of said transfer carrier wheels being located in parallel but separate planes with the mountings of the next consecutive transfer carrier wheel, and in alternating planes with said guide roller tracks, so that the two rollers of each said pair of rollers mounted on said shafts may alternate in their functions as supporting rollers and guide rollers as the related transfer mould assembly is transferred from one mould carrier to another, (b) said orientation system including:

(i) said orienting lever arms fitted on the ends of each of the two shafts mounted at the opposite ends of each transfer mould assembly have three cam rollers mounted on the outer side of said orienting lever arm at one end of said transfer mould assembly and two cam rollers mounted on the outer side of said orienting lever arm at the other end of said transfer mould assembly, said five cam rollers being circumferentially spaced about said axis of rotation of said transfer mould assembly, (ii) a series of arcuate cam track sections located alongside that portion of a travel path where the transfer mould assemblies are transported on the transfer carrier wheels to cooperate sequentially with one or the other of said five cam rollers at one end or the other of said transfer mould assemblies, and (iii) a pressing system wherein said finishing moulds are supported on radially moveable mountings on said finishing mould carrier wheel, said mountings being urged outwardly of the rotary axis of said finishing mould carrier wheel, including, slotted guide notches located adjacent each end of each of said finishing mould mountings to receive the guide rollers mounted on the shafts at each end of said transfer mould assemblies, a set of four locking pins mounted on each of said transfer mould assemblies arranged to cooperate with locking devices moveably mounted on said finishing mould carrier wheel, said locking devices being automatically operable to lock each of said transfer mould assemblies in a pressing position during a pressing action as said transfer moulds are mated with said finishing moulds so as to maintain said transfer moulds in said pressing position while resisting the radially outward force of said pressing action, and subsequently to unlock said transfer mould assemblies as the transfer moulds begin to be unmated from said finishing moulds, each of said transfer mould assemblies being guided in cyclical order into and out of the locking position by the action of said guide rollers travelling along on said guide tracks.

3. The mould transfer mechanism of claim 2 wherein said input mould carrier wheel rotates into and out of a vat containing materials to be moulded and to form moulded preforms in said input moulds mounted thereon.

4. The mould transfer mechanism of claim 2 wherein said transport and orientation system is extended and includes a twin chain conveyor with first and second pairs of sprocket wheels and wherein said first, second and third rotary transfer carrier wheels and said twin chain conveyor are all mounted on axes parallel with each other and with the axes of the input mould carrier wheel and the finishing mould carrier wheel, said first pair of sprocket wheels of said conveyor being located sequentially between said first rotary transfer carrier wheel and said second rotary transfer carrier wheel, said second pair of sprocket wheels being mounted on the shaft of said second rotary transfer carrier wheel, each of the twin chains of said twin chain conveyor having notched links therealong to form releasable mounts for conducting said transfer mould assemblies rotatably along the supporting tracks of said conveyor, including two sets of three rollers mounted on said shafts, one set at each end of each of said transfer mould assemblies, the first roller of each of said sets of three rollers having a smaller diameter for releasable mounting in said notched links, the second roller of each of said sets having a larger diameter and arranged to roll along one of the tracks of said conveyor thereby to retain said first roller in place in the notch of said notched link, the third roller of each of said sets travelling along or beside the tracks of said conveyor for transfer into the releasable mounts of said second rotary transfer carrier wheel.

5. The mould transfer mechanism of claim 4 wherein said input mould carrier wheel is arranged to rotate in and out of a vat containing moulding materials, from which to form moulded preforms in said input moulds.

6. The mould transfer mechanism of claim 1 wherein said input mould carrier is a rotary input mould carrier wheel and wherein said finishing mould carrier is a rotary finishing mould carrier wheel, each mounted on parallel axes for continuous synchronized motion in an endless path, and wherein said transfer carrier wheel has a central shaft, a transport and orientation system for transporting said transfer mould assemblies back and forth between said input mould carrier wheel and said finishing mould carrier wheel, said transport and orientation system comprising:

(a) a rotary transfer carrier wheel mounted on an axis parallel to the axes of said input mould carrier wheel and said finishing mould carrier wheel for synchronized continuous motion controlled by a gear train, and (b) a twin chain conveyor with an endless travel path about a pair of sprockets mounted on the central shaft of said transfer carrier wheel and along arcuate chain guide tracks leading from said sprockets to said finishing mould carrier wheel and thence onward on continuing chain guide tracks mounted externally of the circumference of said finishing mould carrier wheel and thence returning along a second pair of arcuate chain guide tracks towards said pair of sprockets on said transfer mould carrier wheel.

* * * * *

UNITED STATES PATENT AND TRADEMARK OFFICE

CERTIFICATE OF CORRECTION

PATENT NO. : 5,174,863

DATED : December 29, 1992

INVENTOR(S) : Roy William Emery

It is certified that error appears in the above-indentified patent and that said Letters Patent is hereby corrected as shown below:

Column 11, line 45, after "continuous motion" delete "through" and insert --throughout--.

Column 13, line 6, after "transport system" delete "transport" and insert --transports--.

Signed and Sealed this

Twenty-sixth Day of October, 1993

*Attest:*

*Attesting Officer*

Bruce Lehman

BRUCE LEHMAN

*Commissioner of Patents and Trademarks*